US005150101A

United States Patent [19]

Goris et al.

[11] Patent Number: 5,150,101

[45] Date of Patent: Sep. 22, 1992

[54] SECURITY SYSTEM FOR CIGARETTE DISPLAY CASE

[75] Inventors: Donald L. Goris, Grand Rapids; David A. Noorman, Jenison, both of Mich.

[73] Assignee: MiQuest Corporation, Grand Rapids, Mich.

[21] Appl. No.: 673,183

[22] Filed: Mar. 20, 1991

Related U.S. Application Data

[63] Continuation of Ser. No. 575,909, Aug. 31, 1990, abandoned.

[51] Int. Cl.[5] ..... G08B 21/00

[52] U.S. Cl. ..... 340/568; 221/2; 221/3; 340/526; 340/529; 340/539

[58] Field of Search ..... 340/568, 556, 539, 526, 340/529, 530; 221/3, 2, 7, 8

[56] References Cited

U.S. PATENT DOCUMENTS 4,007,853 2/1977 Banneman ..... 221/3

4,358,756 11/1982 Morel et al. ..... 340/539

*Primary Examiner*—Glen R. Swann, III

*Attorney, Agent, or Firm*—Brooks & Kushman

[57] ABSTRACT

An anti-pilferage alarm system for a cigarette carton display case. The system includes optical detectors, a control microprocessor, and an alarm. The detectors optically detect the presence of cartons within the shelf exit openings and emit carton-present signals upon such detection. The microprocessor is responsive to the signals and activates an alarm when a preselected detector signal pattern is observed. In the preferred embodiment, the alarm patterns include four signals within 15 seconds or one signal having a duration of 6.5 seconds.

18 Claims, 2 Drawing Sheets

SECURITY SYSTEM FOR CIGARETTE DISPLAY CASE

This is a continuing application of application Ser. No. 07/575,909, filed Aug. 31, 1990, now abandoned.

BACKGROUND OF THE INVENTION

The present invention relates to alarm systems, and more particularly to alarm systems for display cases such as those for cigarette cartons.

A wide variety of display cases has been developed for displaying products and making the products accessible for customer removal. Such display cases are used in particular for the vending of cigarette cartons. Typically, such cases include a plurality of shelves on which the cartons are stacked and a security shield or gate on each shelf to permit only the bottom carton on each shelf to be withdrawn. The cartons remaining on the shelf then drop to fill the void created by removal of the bottom carton.

Unfortunately, theft or pilferage from such display cases is an increasingly common problem. Often, the cases are located in convenience stores or gas stations wherein the employees cannot give their full attention to the monitoring of all products within the store. Because of the large number of cartons available within the display case, a shoplifter may easily remove a number of cartons within a few seconds.

Prior artisans have attempted to develop alarm systems for such cases. One weight-actuated system is illustrated in U.S. Pat. No. 4,819,015 issued Apr. 4, 1989 to Bullivant et al and entitled ANTI-THEFT PRODUCT RACK AND METHOD. The Bullivant case includes a number of weight-sensing detectors for monitoring the weight of product within the case. A control system is coupled to the weight sensors, and weight deviations are monitored and distinguished as either a disturbance or a product removal. Based on this distinction, the control circuit then determines whether a theft or pilferage pattern has occurred. The control system sounds an alarm if such a pattern is detected. However the Bullivant alarm system is not without its drawbacks. First, the weight sensors are subject to miscalibration—both initially and during subsequent use. Second, the control circuitry must be sophisticated to discriminate between disturbances and removals and then to further distinguish between theft conditions and acceptable product movement. Third, all of the product within the display case is accessible simultaneously to the consumer. This results in cartons being accidentally knocked out of the case and also creates a more attractive target for the shoplifter.

Optical detection systems are known in the hotel room bar vending area. Exemplary teachings are provided in U.S. Pat. No. 4,791,411 issued Dec. 13, 1988 to Staar and entitled MANUAL FREE-ACCESS VENDING MACHINE; and U.S. Pat. No. 4,629,090 issued Dec. 16, 1986 to Harris et al and entitled HOTEL ROOM BAR WITH OPTICAL SENSING SYSTEM. The Staar system includes an optical detector associated with each product location. The Harris system includes an optical sensor at each product exit opening. In both systems, the optical detectors sense product removal, and the systems provides an automatic billing function in response to such removal. These systems are not designed to, and do not provide, any type of alarm.

Further, they make no attempt to distinguish between acceptable and unacceptable product removal.

SUMMARY OF THE INVENTION

The aforementioned problems are overcome in the present invention which provides a security system for accurately and simply monitoring acceptable and unacceptable product removal from a display case. The system includes a plurality of optical detectors, one associated with each product exit opening so that the removal of each individual product can be monitored. The system further includes an alarm and a control system for actuating the alarm when predetermined theft conditions are detected. In the preferred embodiment, one alarm condition is the removal of a predetermined number of cartons within a predetermined time period (e.g. four cartons within 15 seconds). A second preferred alarm condition is the presence of a product within an exit opening for a predetermined time period (e.g. 6.5 seconds).

The optical sensing of product removal enhances the reliability of the system over previous display case alarms. Each product removal is positively sensed and need not be inferentially calculated from weight. Further, the optical sensors are not subject to miscalibration or subsequent deviation with use and/or age. Further, the defined alarm conditions more accurately discriminate between acceptable and unacceptable product removal. Such discrimination is important, first, to minimize the number of "false" alarms potentially embarrassing to customers and, second, to sound the alarm as soon as actual theft is occurring.

These and other objects, advantages, and features of the invention will be more fully understood and appreciated by reference to the detailed description of the preferred embodiment and the drawings.

DETAILED DESCRIPTION OF THE PREFERRED EMBODIMENT

Figure 4:
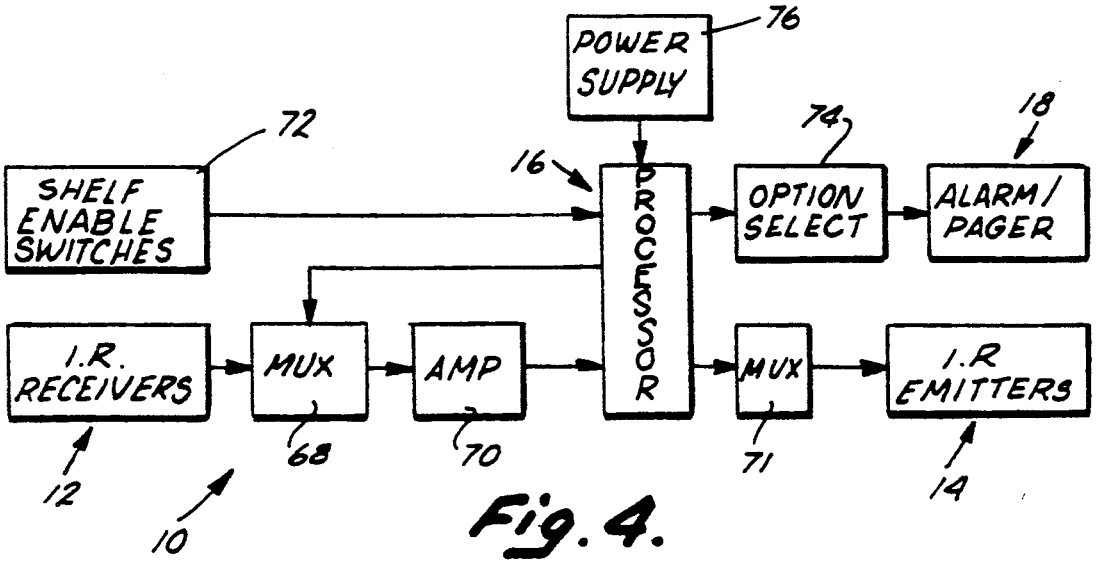
FIG. 4 is a schematic diagram of the display case security system.

A security system for a cigarette display case is illustrated in FIG. 4 and generally designated 10. The system includes a plurality of infrared (IR) receivers 12, a plurality of IR emitters 14, a processor 16, and an alarm 18. The receiver/emitter pairs 12, 14 are mounted adjacent each shelf exit opening (see FIG. 2) to monitor product removal. The processor 16 is responsive to the detector signals and discriminates between acceptable and unacceptable product removal. If the product removal is unacceptable, the alarm 18 is actuated to alert store personnel of the potential theft situation.

The cigarette display case 20 (FIG. 1) on which the security system 10 is installed is generally well known to those having ordinary skill in the display case art and will not be described in detail. An exemplary case is that sold as Model System 2000 by Harbor Industries, Inc. of Grand Haven, Mich. Generally, the case 20 includes a plurality of shelf units 22*a*, 22*b*, and 22*c*, which are arranged in a U-shaped configuration. Each shelf unit 22a includes seven shelves 23 and is topped by a header 24. The header includes a front panel 26 for displaying advertising information 28 and an internal void or space 30.

Figure 1:
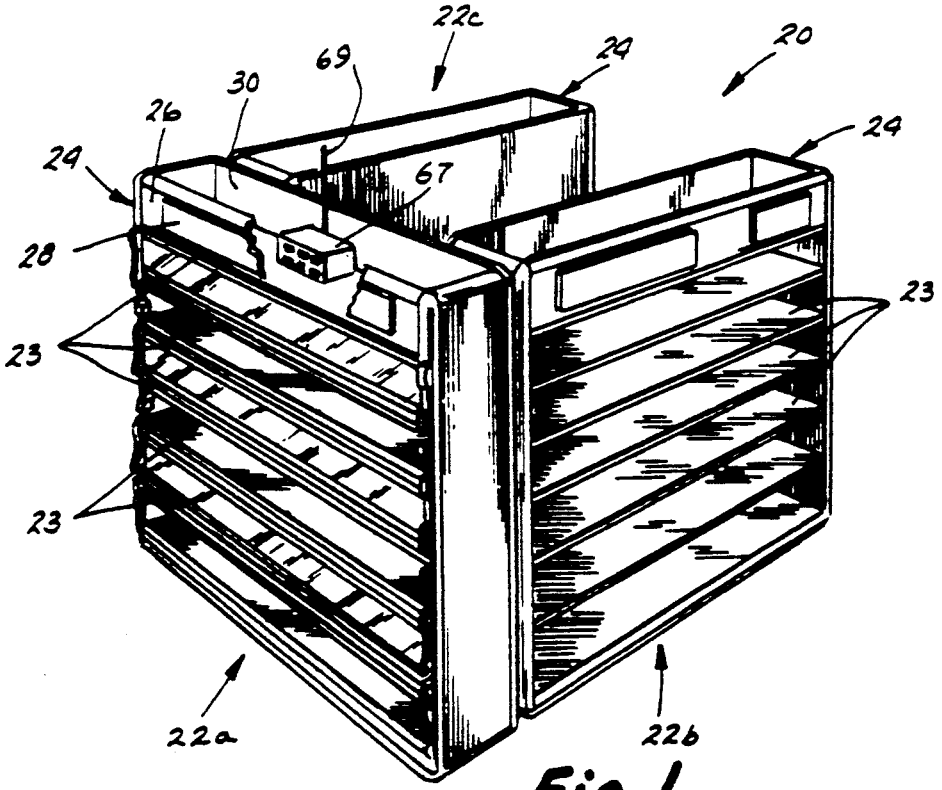
FIG. 1 is a perspective view of a cigarette display case with the security system of the present invention.
Figure 2:
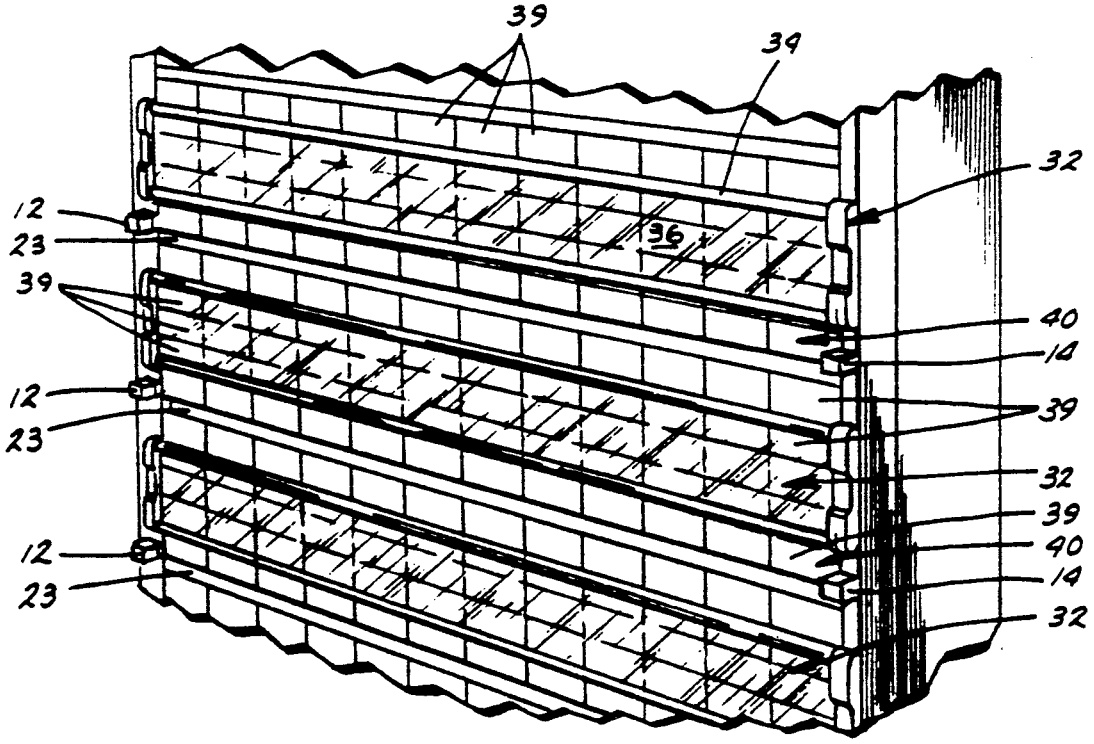
FIG. 2 is a fragmentary perspective view of one bank of shelves of the display case with the security system installed.
Figure 3:
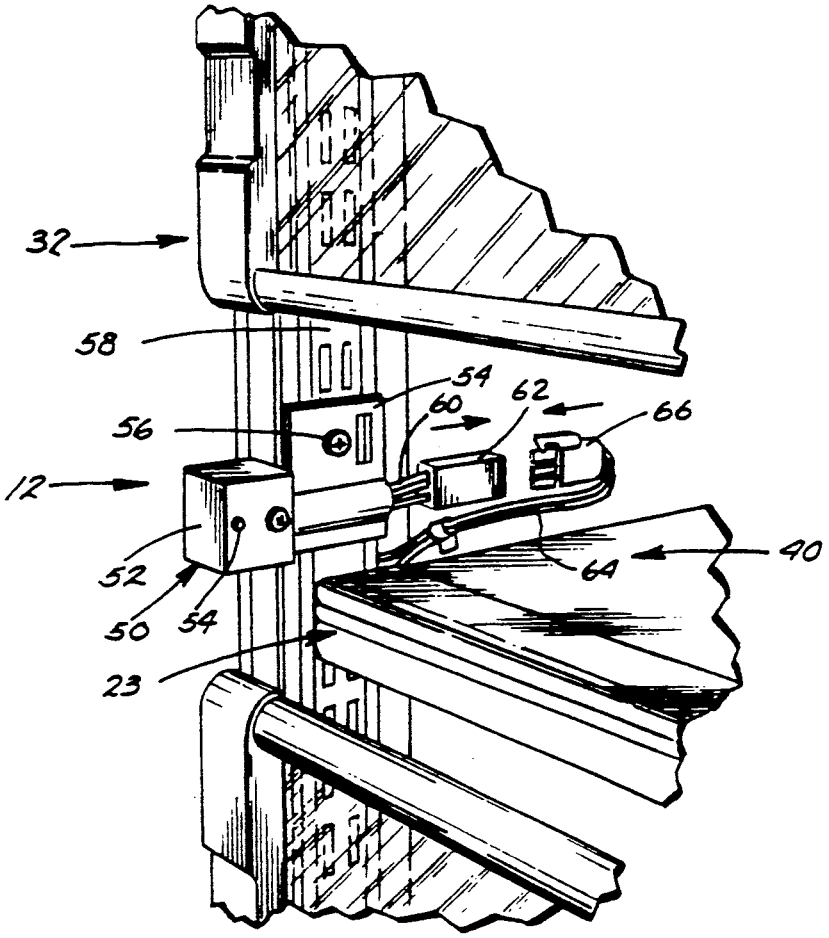
FIG. 3 is a fragmentary perspective view of one optical sensor at one shelf exit.

As more clearly illustrated in FIGS. 2 and 3, a security shield or gate 32 is pivotally mounted over each shelf. Each gate 32 includes a frame 34 supporting a transparent panel 36. The gates 32 are mounted in conventional fashion on the display case and are hinged at their upper edge to be pivotal between an open position (not shown), wherein the gate extends out from the shelf unit 22, and a closed position, illustrated in FIGS. 1, 2 and 3.

The shelves 23 are vertically spaced enabling a plurality of products or cartons 39 to be vertically stacked on each shelf. A product exit opening 4 is defined between the lower edge of each gate 32 and the associated shelf 23. The height of the exit opening 40 is selected to be greater than the height of a single product but less then the height of two stacked products. Consequently, only one product in the vertical stack on the shelf may be withdrawn through the exit opening 40 at a time. After a product is withdrawn, the remaining products in the stack previously above the withdrawn products drop to the shelf to place a new product in position for removal.

One IR receiver 12 and one IR emitter 14 are mounted at opposite ends of each shelf across the exit opening 40 (FIG. 2). The emitter 14 directs IR light toward the receiver 12. The beam is unbroken when products are not within the exit opening 40, and the beam is broken when a product is in the exit opening.

The receiver 12 is illustrated in greatest detail in FIG. 3 and includes a housing/bracket assembly 50 having a housing portion 52 and a bracket portion 54. The housing portion 52 is a rectangular parallelopiped enclosing the receiver element 54. The bracket portion 54 is secured using screw 56 to the conventional slotted bracket support 58 of the case 20. The emitter element 54, namely a phototransistor, is connected through wires 60 to plug 62. The processor 16 (see FIG. 4) is coupled via wires 64 to plug 66. The plugs 62 and 66 can be interfitted to connect the receiver element 54 with the processor 16. The wires 64 and plugs 62 and 66 can be covered or hidden using moldings (not illustrated).

The emitters 14 (FIG. 2), namely light-emitting diodes (LEDs), are mounted in a housing/bracket not illustrated in detail. However, the emitter mounting arrangement is generally identical to the receiver mounting arrangement, being the mirror image thereof.

All components of the security system illustrated in FIG. 4, other than the receivers 12 and the emitters 14, are contained within a housing 67 (FIG. 1). The housing is preferably placed or located in the header void 30 to be inconspicuous. An antenna 69 is mounted on the housing for RF transmissions. The alarm/pager 18 includes both a speaker in the housing 67 ad a conventional pager with audible alarm to be carried by a store employee. Other alarm means may be used to emit other than audible alarms.

Turning to FIG. 4, the receivers 12 and the emitters 14 are coupled via the multiplexers (MUX) 68 and 71, respectively, to the microprocessor 16. The processor or control means 16 in the preferred embodiment is that sold as Model MC68705P3 by Motorola. Of course, other digital devices may be substituted therefor. A conventional power supply 76 is provided to couple the five-volt processor 16 with 110-volt line power.

The shelf-enable switches 72 (FIG. 4) are coupled to the microprocessor 16. In the preferred embodiment, these are DIP switches located on the face of the housing 67. In the preferred embodiment, the processor 16 is capable of monitoring up to 32 shelves. One shelf enable switch 72 is provided for each possible shelf. The switch is turned on if an emitter/receiver pair is associated with the input (i.e. mounted on a shelf) and is turned off if a pair is not associated with the input (i.e. not mounted on a shelf). Therefore, the shelf enable switches 72 enable the unit to accommodate anywhere between one and 32 shelves, inclusive.

The option-select switches 74 (FIG. 4) are interposed between the processor 16 and the alarm/pager 18. In the preferred embodiment, the option-select switch 74 is a four-switch pad accessible on the face of the control unit The four switches are denominated and have associated functions as follows:

| Switch Name | Function |
|---|---|
| First Miss | Enables/disables audible alarm when the first carton in any predefined time interval is withdrawn |
| Multiple Tone Alarm | Enables/disables alarm to provide a multiple-tone signal |
| Speaker Off/On | Enables/disables the audible alarm on and off |
| Pager Off/On | Enables/disables the RF transmitter |

Operation

Prior to actuation of the alarm system, the display case 20 is filled with cartons as necessary. Restocking is accomplished in conventional fashion by lifting all of the gates or security shields 32 to the open position and inserting cartons onto the shelves. The gates 32 are then closed, and the case is ready for actuation of the alarm system.

Power is supplied to the system by power supply 76. Through multiplexer 68, the processor 16 sequentially polls each receiver/emitter pairs 12, 14 indicated to be active by the shelf-enable switches 72. As each pair is sequentially active, the IR emitter produces IR light having a wave length of approximately 880 nanometers (nm). In the preferred embodiment, each emitter/-receiver pair 12, 14 is polled 16 times per second. The sequential polling of the pairs prevents cross talk between emitters, which might result in erroneous signals.

The amplifier 70 amplifies the signals received from the multiplexer 68 to an appropriate level for use by the processor 16. The amplifier is of conventional design and will depend on the particular components used.

The processor monitors the signal condition of each emitter/receiver pair 12, 14 to detect theft or pilferage conditions or patterns of signals. A first theft condition is defined as a predetermined or preselected number of product movements at any of the shelf exits 40 within a predetermined or preselected period of time. In the preferred embodiment, such condition is defined as four product movements anywhere within the case in any 15 second interval. A second alarm condition is defined as the presence of a product within, or blocking, an exit opening for a predetermined or preselected period of time In the preferred embodiment, this is defined as 6.5 seconds.

Programming of the processor 16 will be readily apparent to those having ordinary skill in the art. An exemplary algorithm is appended hereto as Appendix 1. Generally speaking, the openings 40. When a product is present, a 15-second time interval is initiated. If three additional product movements are detected within the 15-second period, an alarm signal is sent to the option select block 74. Additionally, the processor 16 monitors the duration of each product-present signal at each exit opening 32. If a product is present in any opening for 6.5 seconds, an alarm signal is sent to the option select block 74.

Depending on the options selected using the switches 74 as discussed above, the alarm signal will be sent to the alarm/pager 18. If the speaker is actuated, an audible alarm will be sounded at the housing 67. If the pager is actuated, an RF transmission occurs using antenna 69 to activate the remote pager, which also sounds an audible alarm.

The present invention positively and accurately monitors product movement and determines with improved accuracy product movement patterns indicative of theft or pilferage. At the same time, the system minimizes false alarms, providing a system of enhanced simplicity and reliability.

The above description is that of a preferred embodiment of the invention. Various alternations and changes can be made without departing from the spirit and broader aspects of the invention as defined in the appended claims, which are to be interpreted in accordance with the principles of patent law including the doctrine of equivalents.

APPENDIX 1

| Word/Phrases | Meaning |
|---|---|
| CYCLE | The monitor of one input line |
| SCAN | The checking of all inputs (32 cycles) |
| CLEAR INPUT | An input where the IR is passed through |
| MISSED INPUT | An input where the IR is not passed through |
| BLOCKED INPUT | An input that is MISSED for at a minimum of .25 sec. |
| INTERRUPTED CYCLE | A .25 to 6 sec. BLOCKED INPUT followed by a CLEAR INPUT |
| BLOCKED SHELF | A BLOCKED INPUT that lasts for 6.5 seconds or more |
| BEEP | A single chime on the speaker |
| ALARM | Five chimes on the speaker |
| PAGE | Activate AutoPage Payer |
| LOOP TIMING SPECIFICATIONS | |
| Cycle Time | 2 milliseconds |
| Scan Time | 64 milliseconds (15.62 scans/second) |

CYCLE SPECIFICATIONS

```
Loop Start
For INPUT (X) = 0 to 31
 If INPUT (X) ENABLED then
  Set DATABUS to Section (X).
  Output a 200 microsecond pulse to IR Transmitter (X)
  Monitor IR Receiver (X) for CLEAR or BLOCKED INPUT.
  If BLOCKED INPUT
   Increment Blocked Input Counter (X) (BIC(X))
   If BIC(X) > 100 then Increment BLOCKED SHELF FLAG
   (6.5 Seconds)
  Else
   If BIC(X) > 100 then Decrement BLOCKED SHELF FLAG
   If BIC (X) > 2 Then Set INTERRUPTED CYCLE FLAG
   (.25 to 6 Seconds)
   Reset BIC(X) to 0
```

-continued

APPENDIX 1

```
  End if
  If BIC(INPUT) <> 0 then Turn on LED(X)
  End if
 NEXT INPUT
 IF BLOCKED SHELF FLAG set
  Turn on BLOCKED SHELF LED
  ALARM
  PAGE
 Else
  Turn OFF BLOCKED SHELF LED
 End if
 If INTERRUPTED CYCLE FLAG set then
  Reset 15 Second Window Counter
  If NIGHT MODE Then Go to Case 4
  Increment INTERRUPTED CYCLE COUNTER (ICC)
  Select Case ICC
  Case = 1
   If FIRST MISS OPTION Disabled then BEEP
  Case = 2,3
   BEEP
  Case = 4 +
   ALARM
   PAGE
  End Select
 End if
 Increment 15 Second Window Counter
 If Window Counter > 15 Seconds Then
  Clear INTERRUPTED CYCLE COUNTER (ICC)
 End if
 LOOP END
```

The embodiments of the invention in which an exclusive property or privilege is claimed are defined as follows:

1. A cigarette display case having a plurality of shelves each having an exit through which a single carton of a vertical stack may pass, comprising:

detector means for optically detecting the presence of a carton within any one of said exits;

control means responsive to said detector means for emitting an alarm signal when either (1) a predetermined number of cartons have passed through said exits within a first predetermined period of time, or (2) a carton remains within one of said exits for a second predetermined period of time, said control means including means for polling said detector means; and alarm means responsive to said control means for emitting an alarm when said control means emits the alarm signal.

2. A cigarette display case as defined in claim 1, wherein an amplifier is coupled to said detector means to amplify an output signal from said detector means, the output of said amplifier being coupled to an input of said control means.

3. A cigarette display case as defined in claim 1, further including switches for selectively enabling respective ones of said detector means for each of said shelves, whereby detector means for those shelves not having cartons thereon may be disabled.

4. A cigarette display case as defined in claim 1, wherein said detector means includes an optical emitter and an optical detector for each of said shelves.

5. A cigarette display case as defined in claim 4, wherein said means for polling sequentially polls the emitter and detector associated with each of said shelves whereby the emitter and detector for only one shelf are enabled at any one time to prevent cross-talk between emitters and detectors for different shelves.

6. A cigarette display case as defined in claim 5, further including a housing, each detector means including an optical emitter mounted to the display case housing and an optical detector mounted to the display case housing.

7. A cigarette display case security system as in claim 6, further including a first conductor coupled to each optical emitter and a corresponding second conductor coupled to said control means whereby said first and second conductors are selectively interconnected to couple a selected emitter to said control means.

8. A display case as defined in claim 6, wherein said control means is mounted within said housing.

9. The system as defined in claim 4, wherein each said emitter is an infrared transmitter.

10. The system as defined in claim 9, wherein each said infrared emitter is enabled by a pulse from said control means.

11. The display case as defined in claim 10, wherein said optical detector is an infrared receiver.

12. The display case as defined in claim 11, wherein said control means determines said shelf is blocked when an infrared signal is not detected by one of said infrared receivers while one of said infrared transmitters is enabled by a pulse.

13. A cigarette display case as defined in claim 12, further including a counter which counts the time period during which a shelf is blocked.

14. A display case with security system having a case for storing articles and having an exit opening through which articles pass when removed from said case, comprising:

detector means for optically detecting the presence of a carton within said exit opening and emitting an article-present signal when such presence is detected;

control means responsive to said detector means for emitting an alarm signal upon the determination of a predetermined pattern of the article-present signals, said control means including means for polling said detector means; and alarm means responsive to said control means for emitting an alarm upon occurrence of the alarm signal.

15. A display case as defined in claim 14, wherein an amplifier is coupled to said detector means to amplify an output signal from said detector means, the output of said amplifier being coupled to an input of said control means.

16. A display case as defined in claim 14, further including switches for selectively enabling a respective detector means associated with each of said shelves, whereby a detector means for a shelf not having cartons thereon may be disabled.

17. A display case as defined in claim 14, wherein said detector means includes an optical emitter and an optical detector for each of said shelves.

18. A cigarette display case as defined in claim 17, wherein said means for polling sequentially polls the emitter and detector associated with each of said shelves whereby the emitter and detector of only one shelf are enabled at any one time to prevent cross-talk between emitters and detectors of different shelves.

* * * * *

UNITED STATES PATENT AND TRADEMARK OFFICE

CERTIFICATE OF CORRECTION

PATENT NO. : 5,150,101

DATED : September 22, 1992

INVENTOR(S) : Donald L. Goris et al.

It is certified that error appears in the above-identified patent and that said Letters Patent is hereby corrected as shown below:

Column 3, Line 17
"4" should be ---40---.

Column 5, Line 6
after "the", insert ---processor 16 monitors for product presence in each of the exit---.

Column 8, Line 2, Claim 14 after "of" delete "a carton" and insert ---an article---.

Signed and Sealed this

Twenty-second Day of March, 1994

Bruce Lehman

BRUCE LEHMAN

*Commissioner of Patents and Trademarks*

*Attest:*

*Attesting Officer*